US005117465A

United States Patent [19]

MacDonald

[11] Patent Number: 5,117,465

[45] Date of Patent: May 26, 1992

[54] EARPHONE WITH ADJUSTABLE HEADBAND WITH PROGRESSIVELY SHALLOW DETENTS

[75] Inventor: James T. MacDonald, Pepperell, Mass.

[73] Assignee: Unex Corporation, Chelmsford, Mass.

[21] Appl. No.: 670,531

[22] Filed: Mar. 15, 1991

[51] Int. Cl.[5] ..... H04R 25/00

[52] U.S. Cl. ..... 381/187; 381/150; 381/182; 381/183

[58] Field of Search ..... 379/419, 428, 430; 381/25, 150, 168, 169, 182, 183, 187, 188

[56] References Cited

U.S. PATENT DOCUMENTS 4,455,457 6/1984 Akira ..... 381/187
4,499,593 2/1985 Antle ..... 381/25

FOREIGN PATENT DOCUMENTS 2643157 4/1978 Fed. Rep. of Germany ..... 381/183
0178798 9/1985 Japan ..... 381/187

*Primary Examiner*—James L. Dwyer
*Assistant Examiner*—William Cumming
*Attorney, Agent, or Firm*—Weingarten, Schurgin, Gagnebin & Hayes

[57] ABSTRACT

An adjustable headset headband including a resilient band of a shape and size to fit over the head of a wearer. The band has a first end and a second end and a positioning member fixedly attached adjacent the first end. The headband also includes a housing having a first end and a second end. The positioning member is movably mounted within the housing such that the second end of the housing is oriented nearest the second end of the band. The housing includes a plurality of depressions linearly arranged within the housing from the first end of the housing to the second end of the housing, each depression of the plurality of depressions having a shallower depth than the preceeding depression. The positioning member releasably engages one of the plurality of depressions so as to maintain the positioning member at a predetermined portion within the housing.

11 Claims, 3 Drawing Sheets

EARPHONE WITH ADJUSTABLE HEADBAND WITH PROGRESSIVELY SHALLOW DETENTS

FIELD OF THE INVENTION

This invention relates to the field of headbands for use with electronic headsets.

BACKGROUND OF THE INVENTION

In many instances, a person wishing to listen privately to acoustic sound, for example from a telephone or a personal stereo player, does not wish to hold the acoustic speaker generating the sound to his ear. One way to accomplish both private listening and hands free use is to position the acoustic speaker adjacent the ear of the listener by use of a headband. Such a headband may either be constructed with a speaker located at one end of a resilient band which fits over the wearer's head, or alternatively, the headband may be constructed with a speaker at each end of the band. The band typically is a partial loop generally in the shape of an inverted U. The band must be deformed by spreading the ends of the band apart in order to fit on the wearer's head. When the band is placed on the wearer's head, the ends are released and the spring tension, due to the band's resilience and the deformation required to fit the band on the wearer's head, holds the speaker against the wearer's ear. Since the distance from the top of the head to each ear is different for each wearer, many headbands have been designed in which the band is adjustable.

Prior headband designs include rack and pinion type mounts joining a separated headband so as to permit the distance between the ends of the headband to be adjusted. Another common method of adjusting the headband is to place the acoustic speaker on a bracket slidably mounted upon the headband. Such an arrangement permits the speaker to move on the headband and thereby adjust the distance between the speaker and the top of the band and therefore adjust the distance between the speaker and the opposite end of the band. Although this form of mounting is common, the design relies on friction to hold the speaker in position. As such, the speaker may need to be adjusted each time the headset is worn.

The present invention relates to a headband with a housing which permits the speaker to be held in a predetermined position while permitting easy adjustment of the position of the speaker on the band.

SUMMARY OF THE INVENTION

A feature of the invention is an adjustable headset headband including a resilient band of a shape and size to fit over the head of a wearer. The band has a first end and a second end and a positioning member fixedly attached adjacent the first end. The headband also includes a housing having a first end and a second end. The positioning member is movably mounted within the housing such that the second end of the housing is oriented nearest the second end of the band. The housing includes a plurality of depressions linearly arranged within the housing from the first end of the housing to the second end of the housing, each depression of the plurality of depressions having a shallower depth than the preceeding depression. The positioning member releasably engages one of the plurality of depressions so as to maintain the positioning member at a predetermined position within the housing.

Another feature of the invention is an adjustable headset including a resilient band of a shape and size to fit over the head of a wearer. The band has a first end and a second end and a positioning member fixedly attached adjacent the first end. The headset further includes a housing having a first end and a second end, and an acoustic speaker movably mounted adjacent the first end of the housing. The positioning member is movably mounted within the housing such that the second end of the housing is oriented nearest the second end of the band. The housing includes a plurality of depressions linearly arranged within the housing from the first end of the housing to the second end of the housing, each depression of the plurality of depressions having a shallower depth than the preceeding depression. The positioning member releasably engages one of the plurality of depressions so as to maintain the positioning member at a predetermined portion within the housing.

Yet another feature of the invention is an adjustable headset including a resilient band of a shape and size to fit over the head of a wearer. The band has a first end and a second end and a positioning bead fixedly attached adjacent the first end. An end pad is fixedly attached to the second end of the band. The housing has a first end and a second end, and an acoustic speaker pivotally mounted adjacent the first end of the housing. The positioning bead is movably mounted within the housing such that the second end of the housing is oriented nearest the second end of the band. The housing includes a plurality of depressions linearly arranged within the housing from the first end of the housing to the second end of the housing. Each depression of the plurality of depressions has a shallower depth than the preceeding depression. The positioning bead releasably engages one of the plurality of depressions so as to maintain the positioning bead at a predetermined portion within the housing.

BRIEF DESCRIPTION OF THE DRAWINGS

Other features and benefits of the invention can be more clearly understood with reference to the specification and the accompanying drawings in which.

DESCRIPTION OF THE PREFERRED EMBODIMENT

Figure 1:
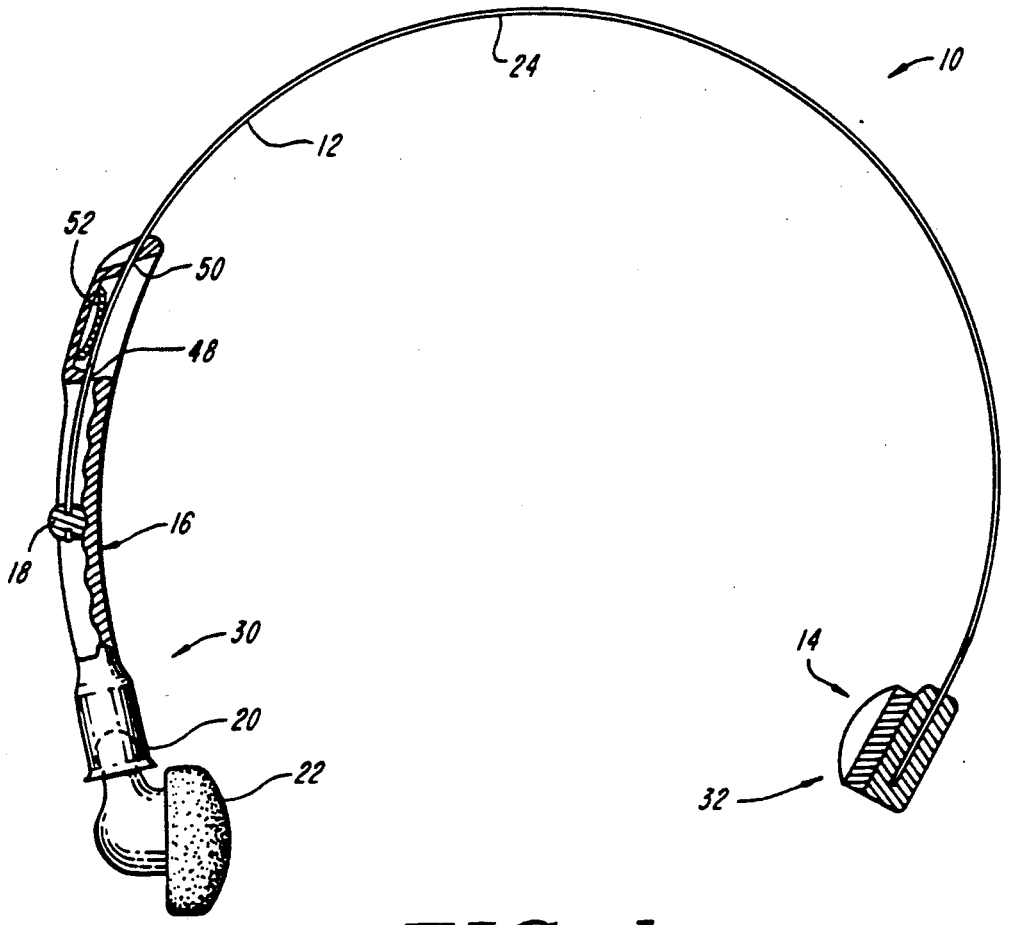
FIG. 1 is an embodiment of the invention used with a single miniature speaker.
Figure 2:
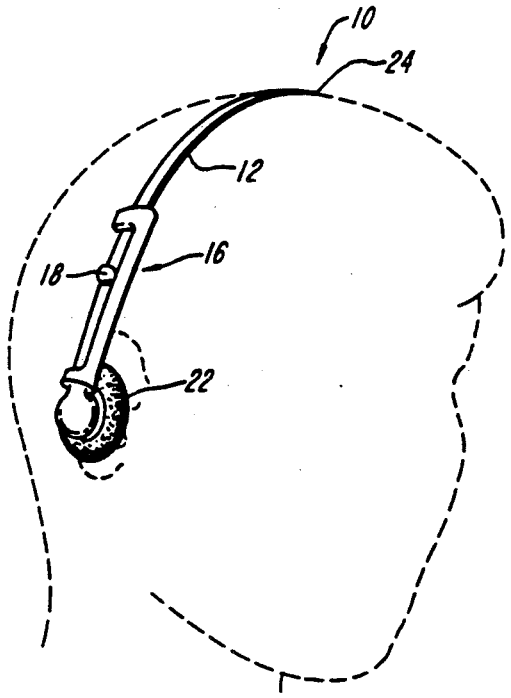
FIG. 2 is a diagram of the embodiment of the invention shown in FIG. 1 positioned on the head of a wearer.

In brief overview and referring to FIG. 1, an embodiment of the invention 10 for use with a single miniature speaker 22 includes a headband 12, an end pad 14, and an miniature speaker 22 (earbud) mounted on a housing 16. The headband 12 is a resilient band in the shape of a partial loop or inverted U. The band may be made of a metal such as stainless steel or any other durable resilient material which produces a strong restoring force to deformation. To wear the headband 10, the ends 30, 32 of the band 12 are pulled apart and the band 12 is fit on the wearer's head as shown in FIG. 2. The top of the loop 24 rests upon the top of the wearer's head, while the ends 30, 32 of the band 12 apply approximately radially directed pressure to the user's head as the band 12 attempts to restore its original undeformed shape.

At one end of the headband 12 is an end pad 14. The end pad 14 cushions that end 32 of the resilient band 12 and when on the wearer's head, distributes the force being applied to the wearer's head by the end 32 of the band 12. The end pad 14 may take on a variety of forms, in addition to the substantially circular pad shown. For example, the pad may be an elongated strip of plastic oriented perpendicular to the band 12. The end pad 14 may also be replaced by a second miniature speaker in a two speaker headset.

The other end 30 of the band 12 is movably mounted within a housing. A miniature speaker 22 is movably mounted at the end 30 of the housing 16 furthest away from the resilient band 12. The speaker 22 may be mounted to the housing 16 by a ball joint 20 or any other movable joint known to the art. The movable joint permits the speaker 22 to rest flush against the ear of the wearer regardless of the position of the housing 16 on the band 12. Because the band 12 is movably mounted within the housing 16, the distance between the top of the band 24 and the speaker 22 may be adjusted to closely match the distance from the wearer's ear to the top of the wearer's head.

Figure 3A:
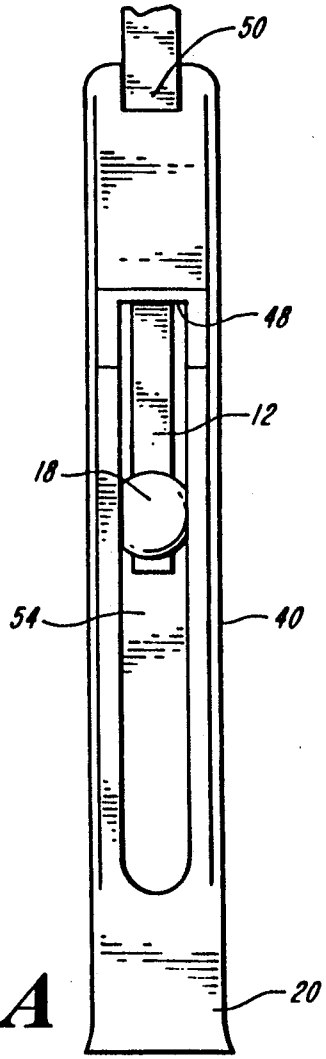
FIG. 3*a* is a front view of the housing and band of FIG. 3.
Figure 3:
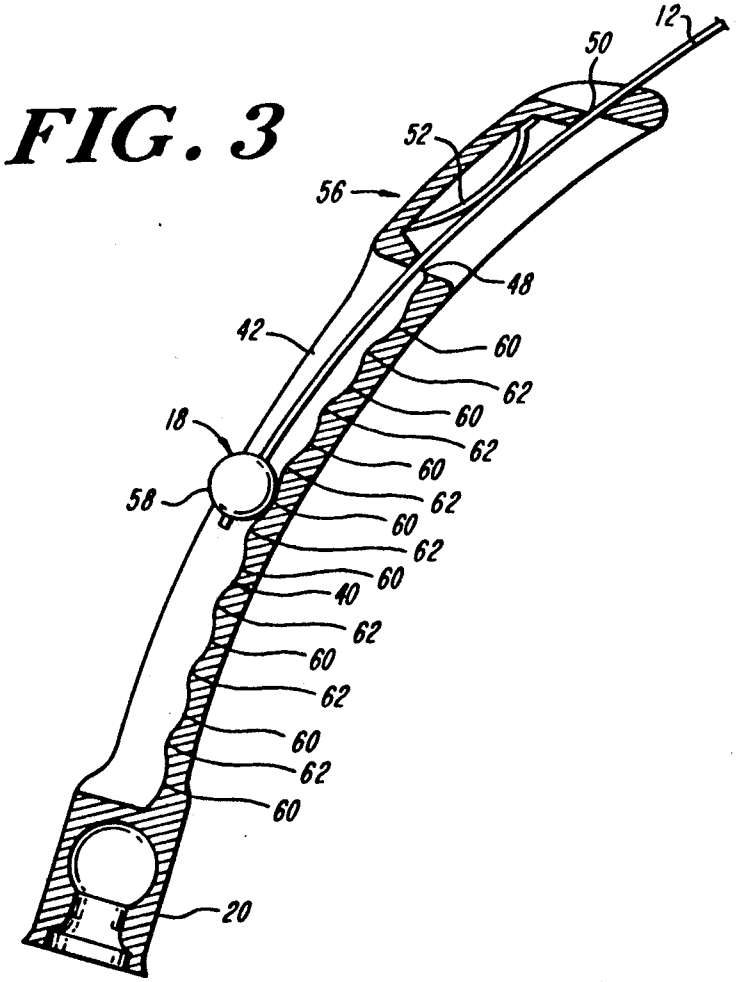
FIG. 3 is a cross-sectional view of the housing and band of the embodiment of the invention shown in FIG. 1.

Referring also to FIGS. 3 and 3*a*, the portion of the band 12 which is movably mounted within the housing 16, is slidably extended through an upper slot 50 and a lower slot 48 into the main body of the housing 16. A bead 18 is fixedly attached to the end of the band 12 positioned within the housing 16 and one surface of the bead 18 makes contact with one of a series of depressions 60 in the inner surface 40 of the housing 16. The bead 18 is biased against with the inner surface 40 of the housing 16 by a leaf spring 52 which is positioned between the band 12 and the closed upper portion 56 of the housing 16 between the slots 48, 50.

A slot 54 in the upper surface of the housing 42 permits the portion 58 of the bead 18 not in contact with the inner surface 40 to project slightly from the housing 16. The slot 54 thereby constrains the bead 18 to move along the slot 54 and hence the center line of the housing 16 as the bead 18 moves within the housing 16.

Figure 4:
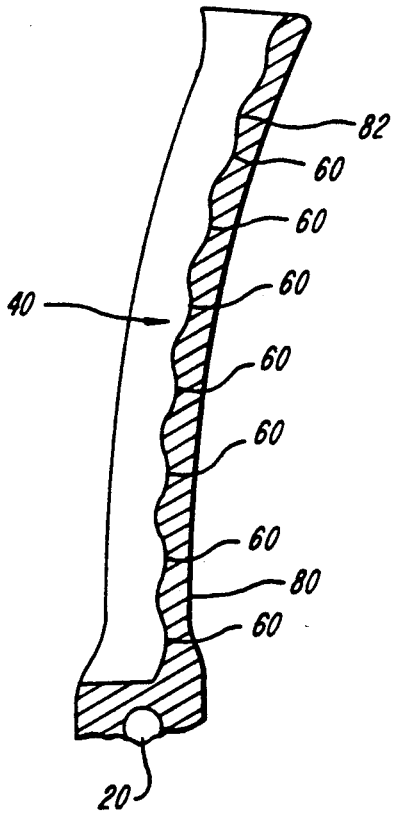
FIG. 4 is an enlarged cross-sectional view of the inner surface of the ratchet housing shown in FIG. 3.

Referring to FIG. 4, each subsequent depression 60 of the series of depressions in the inner surface 40 of the housing 16 is separated from each previous depression by a peak 62 which is lower than each preceeding peak 62, measured as one proceeds from the end of the housing 16 nearest the speaker 22 to the end of the housing 16 furthest the speaker 22. Each projection 62 merges smoothly into the adjacent depressions 60. This combination permits less of the bead 18 to rest in the depression 60 furthest away from the speaker 22 than rests in the depression 60 nearest the speaker 22. That is to move the bead 18 from one depression 60 to the next (moving away from the speaker 22), the bead 18 must be moved over increasingly shallow peaks 62.

The reason for this configuration is as the distance from the speaker 22 to the top 24 of the band 12 is increased by sliding the bead 18 in a direction away from the speaker 22, the distance between the lower slot 48 of the housing 16 and the bead 18 decreases. This results in a shorter moment arm and hence an increase in the amount of force required to move the bead 18 away from the inside surface 40 of the housing 16 so as to move the housing 16 on the band 12. Therefore, since less force is required by the band 12 to hold the bead 18 against the inner surface 40 of the housing 16, less of the the bead 18 needs to rest in the depression 60 in order to hold the bead 18 within the depression 60. Conversely, as the bead 18 is moved toward the speaker 22, the moment arm between the bead 18 and the lower slot 48 increases and therefore less force is needed to move the bead 18 away from the inner surface 40 of the housing 16. Therefore, as the bead 18 is moved toward the speaker 22, more of the bead 18 must be in contact with the depression 60 to hold the bead 18 so as to maintain its position within the housing 16.

FIG. 4 shows a cross-sectional view of the inner surface 40 of the housing 16. In the embodiment shown, there are eight depressions 60 and seven projections 62. The projection 80 nearest the speaker mount 20 has a radius of 0.035 inches while the projection 82 furthest from the speaker 22 has a radius of about 0.25 inches. Each of the depressions 60 has a radius of 0.125 inches and the angular distance between each of the projections 62 is about 30 degrees or about 0.2 inches.

Although only a one speaker band is shown, the present invention can be used to adjust both speakers of the two speaker headset. These and other examples of the concept of the invention illustrated above are intended by way of example and the actual scope of the invention is to be determined solely from the following claims.

What is claimed is:

1. An adjustable headband comprising:

a resilient band of a shape and size to fit over the head of a wearer, said band having a first end and a second end and having a positioning member fixedly attached adjacent said first end; and a housing having a first end and a second end, said positioning member movably mounted within said housing such that said second end of said housing is oriented nearest said second end of said band, said housing comprising a plurality of depressions linearly arranged within said housing from said first end of said housing to said second end of said housing, each said depression of said plurality of depressions having a shallower depth than the preceeding depression, said positioning member releasably engaging one of said plurality of depressions so as to maintain said positioning member at a predetermined position within said housing.

2. The headband of claim 1 wherein said housing defines a bore within which said positioning member is movably mounted.

3. The headband of claim 1 wherein said positioning member is a bead.

4. The headband of claim 1 further comprising an end member positioned adjacent said second end of said band.

5. The headband of claim 1 wherein said positioning member passes into said housing through a second slot and a first slot located at said second end of said housing.

6. The headband of claim 5 wherein said headband further comprises a spring located between said first slot and said second slot and positioned so as to bias said positioning member toward and inner surface of said housing.

7. The headband of claim 1 wherein said housing further includes a longitudinal slot in said housing, said longitudinal slot extending in a direction from said first end of said housing to said second end of said housing, said positioning member partially extending from said housing through said slot.

8. The headband of claim 1 further comprising a plurality of ridges, one of said ridges located between each depression.

9. The headband of claim 8 wherein each said ridge of said plurality of ridges has a decreased height relative to the preceeding ridge.

10. An adjustable headset comprising:

a resilient band of a shape and size to fit over the head of a wearer, said band having a first end and a second end and having a positioning member fixedly attached adjacent said first end;

a housing having a first end and a second end, and an acoustic speaker movably mounted adjacent said first end of said housing;

said positioning member movably mounted within said housing such that said second end of said housing is oriented nearest said second end of said band, said housing comprising a plurality of depressions linearly arranged within said housing from said first end of said housing to said second end of said housing, each said depression of said plurality of depressions having a shallower depth than the preceeding depression, said positioning member releasably engaging one of said plurality of depressions so as to maintain said positioning member at a predetermined position within said housing.

11. An adjustable headset comprising:

a resilient band of a shape and size to fit over the head of a wearer, said band having a first end and a second end and having a positioning bead fixedly attached adjacent said first end;

an end pad fixedly attached to said second end of said band;

a housing having a first end and a second end; and an acoustic speaker pivotally mounted adjacent said first end of said housing;

said positioning bead movably mounted within said housing such that said second end of said housing is oriented nearest said second end of said band, said housing comprising a plurality of depressions linearly arranged within said housing from said first end of said housing to said second end of said housing, each said depression of said plurality of depressions having a shallower depth than the preceeding depression, said positioning bead releasably engaging one of said plurality of depressions so as to maintain said positioning bead at a predetermined position within said housing.

* * * * *